United States Patent [19]

Hornig

[11] 3,935,888

[45] Feb. 3, 1976

[54] MANUFACTURE OF VENEER SHEETS

[75] Inventor: Peter K. Hörnig, Berlin, Germany

[73] Assignee: C.L.P. Fleck Sohne GmbH, Berlin, Germany

[22] Filed: Nov. 6, 1973

[21] Appl. No.: 413,375

[52] U.S. Cl. ..... 144/327; 144/2 R; 144/324; 214/6 C; 242/56.1; 242/59; 271/3.1

[51] Int. Cl.[2] ..... B27H 1/00; B65H 39/16

[58] Field of Search ..... 144/321, 2 R, 3 R, 3 E, 144/281 R, 281 A, 281 B, 323, 324, 326, 327, 322, 209 R; 271/3.1; 34/13.8, 16.5, 13.4; 242/56.1, 59; 214/6 C

[56] References Cited

UNITED STATES PATENTS

| | | | |
|---|---|---|---|
| 1,977,503 | 10/1934 | Warren | 242/59 |
| 3,199,555 | 8/1965 | Hildebrand | 144/3 R |
| 3,280,866 | 10/1966 | Erickson | 144/324 |
| 3,447,579 | 6/1969 | Dodge | 144/3 R X |
| 3,545,094 | 12/1970 | Schuette et al. | 34/13.4 |
| 3,566,937 | 3/1971 | Erickson | 144/3 R |
| 3,659,795 | 5/1972 | Bachi et al. | 242/56.1 X |
| 3,739,924 | 6/1973 | Stobb | 214/6 C X |

FOREIGN PATENTS OR APPLICATIONS

| | | | |
|---|---|---|---|
| 893,850 | 4/1962 | United Kingdom | 144/209 |

*Primary Examiner*—J. M. Meister
*Assistant Examiner*—W. D. Bray
*Attorney, Agent, or Firm*—Mason, Mason & Albright

[57] ABSTRACT

Veneer sheets produced by a cutting machine are arranged in groups which are stored. The sheets are subsequently fed from the groups to a drier. The groups are formed by rolls or stacks of sheets.

1 Claim, 1 Drawing Figure

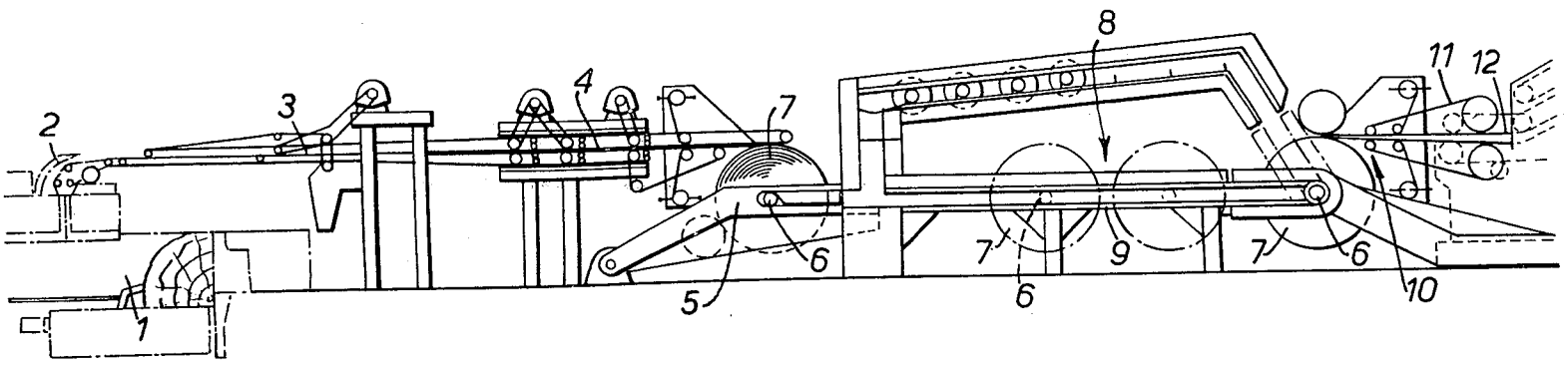
1
2
3
4
5
6
7
8
9
10
11
12

MANUFACTURE OF VENEER SHEETS

BACKGROUND OF THE INVENTION

1. Field of the Invention

The present invention relates to the manufacture of veneer sheets.

2. Description of the Prior Art

In veneer works it is generally usual to feed cut veneer sheets directly into a drier from a cutting machine by way of conveyor belts.

A serious disadvantage of this procedure lies in the dependency of the output of the cut veneer sheets on the output or capacity of the drier. More particularly, the veneer sheets pass through the drier at a speed which is less than the maximum output speed of the cutting machine. The output speed of the cutting machine must therefore be adapted to the speed or output of the drier, whereby efficient use of the full output of the cutting machine necessarily becomes impossible.

Furthermore, during the functionally necessary stopping periods of the cutting machine, for instance during trunk changes, trunk turning and claw change, the drier is not supplied with veneer sheets and is therefore idle.

The dependency of the cutting machine and of the drier on one another thus produces on the one hand a decrease in the output of the cutting machine, because this machine can operate only at a speed adapted to the drier speed, and on the other hand a reduction in the output of the drier also, because while the cutting machine is stationary the drier cannot be supplied with veneer sheets and is therefore idle.

SUMMARY OF THE INVENTION

According to one aspect of the present invention, there is provided a method of manufacturing veneer sheets comprising the steps of cutting veneer sheets, arranging the cut sheets to form groups of cut sheets, storing, and feeding sheets from the groups to a drier at a rate dependent on the output of the drier.

According to another aspect of the invention, there is provided apparatus for manufacturing veneer sheets, cutter means for cutting veneer sheets, means for arranging the cut sheets to form groups of cut sheets, storage means for storing the groups of cut sheets, drier means, and means for feeding sheets from the storage means to the drier means.

BRIEF DESCRIPTION OF THE DRAWINGS

An embodiment of the invention will now be described, by way of example only, with reference to the accompanying drawings, the sole FIGURE of which is an elevation of apparatus for producing veneer sheets.

DESCRIPTION OF THE PREFERRED EMBODIMENT

As shown in the drawing apparatus for producing veneer sheets comprises a cutting machine 1 which cuts veneer sheets and feeds the sheets at spaced intervals. These veneer sheets are supplied by way of a discharge apparatus 2 to a transfer apparatus. Both the discharge apparatus 2 and also the transfer apparatus are known per se, and will not be described in detail. The transfer apparatus 3 preferably comprises two conveyor belts located one above the other, which are guided over appropriate deflecting rollers or deflecting cylinders.

The transfer apparatus 3 now conveys the veneer sheets spaced at intervals from one another to a sheet arranging apparatus 4 where the veneer sheets are orientated and brought together so that the gaps between the individual veneer sheets, which remain unconnected, are taken up and the individual sheets collectively form a veneer strip which is discharged at the end of the sheet sheet arranging apparatus 4. The sheet arranging apparatus 4 is in the form of a conveyor, the speed of which is adjusted so as to cause the gaps between the individual sheets to be closed up. This conveyor also known per se and will not be described in detail.

Winding apparatus 5 is arranged adjacent the end of the snatch apparatus and winds the veneer strip formed by the individual veneer sheets onto a spool 6 so form a veneer roll 7.

The winding apparatus 5 is followed by a storage device 8 which receives the individual veneer rolls 7 one after another. In the apparatus shown in the drawing this storage device comprises a pair of co-operating guides extending in the longitudinal direction to receive the opposite end portions of the spools 6 of the veneer rolls 7.

The storage device 8 can be located laterally with respect to the winding apparatus 5, so that the storage device may occupy any vacant position in the veneer works.

Of the veneer rolls 7 located in the storage device 8, one roll 7 at a time passes to an unwinding apparatus 10 which in the embodiment illustrated comprises an adjustable withdrawal roller which introduces the individual veneer sheets between two intake belts 11 which co-operate with one another and are guided over rollers and the like; these belts feed the veneer sheets into the drier 12.

In an alternative arrangement the individual veneer sheets discharged by the sheet arranging apparatus are arranged in stacks, the stacks of veneer sheets are stored, and thereafter the stored veneer sheets are fed into the drier in accordance with the output capacity of the drier.

Thus in the apparatus particularly described, the output of the cutting machine is independent of that of the drier. The cutting machine and the drier can each be independently operated at maximum output. The veneer sheets cut by the cutting machine at maximum output are stored in stacks or rolls from which they are successively withdrawn according to requirements and to the possible output of the drier. Veneer sheets accumulated in eight hours may for instance be further processed in 16 or 24 hours in the drier.

Moreover, the position of the cutting machine is not dependent on that of the drier, because the veneer sheets do not enter the drier directly but undergo intermediate storage. Further, existing apparatus can readily be modified to provide apparatus in accordance with the invention.

I claim:

1. A method of manufacturing veneer sheets comprising the steps of cutting a plurality of individual veneer sheets, arranging the cut sheets into an adjacent, aligned, relationship, winding the said cut sheets into a roll, conveying said roll of cut sheets to a storage device, and thereafter unwinding the sheets from said roll of cut sheets in said storage device, and feeding the sheets to a drier at a rate dependent on the output of the drier.

* * * * *